US009969603B2

(12) United States Patent
Krulitsch et al.

(10) Patent No.: US 9,969,603 B2
(45) Date of Patent: May 15, 2018

(54) FILLING SYSTEM

(71) Applicant: KHS GmbH, Dortmund (DE)

(72) Inventors: Dieter-Rudolf Krulitsch, Bad Kreuznach (DE); Andreas Fahldieck, Idar-Oberstein (DE)

(73) Assignee: KHS GmbH, Dortmund (DE)

( * ) Notice: Subject to any disclaimer, the term of this patent is extended or adjusted under 35 U.S.C. 154(b) by 81 days.

(21) Appl. No.: 14/904,169

(22) PCT Filed: Jun. 30, 2014

(86) PCT No.: PCT/EP2014/063804
§ 371 (c)(1),
(2) Date: Jan. 11, 2016

(87) PCT Pub. No.: WO2015/003941
PCT Pub. Date: Jan. 15, 2015

(65) Prior Publication Data

US 2016/0145088 A1 May 26, 2016

(30) Foreign Application Priority Data

Jul. 9, 2013 (DE) ..... 10 2013 107 260

(51) Int. Cl.
*B67C 3/26* (2006.01)

(52) U.S. Cl.
CPC ..... *B67C 3/262* (2013.01); *B67C 3/26* (2013.01); *B67C 2003/2602* (2013.01)

(58) Field of Classification Search
CPC ... B67C 3/262; B67C 3/26; B67C 2003/2602; B67C 3/10; B67C 3/2617; B67C 3/2634; B67C 2003/2651
USPC ..... 141/39, 302, 305
See application file for complete search history.

(56) References Cited

U.S. PATENT DOCUMENTS 1,376,088 A * 4/1921 Fowler ..... B67C 3/206 222/381
1,779,739 A * 10/1930 Kantor ..... B67C 3/06 141/286
2,172,012 A * 9/1939 Luhdorff ..... B67C 3/204 141/146
2,212,410 A * 8/1940 Valavan ..... B67C 3/04 141/39
2,671,591 A * 3/1954 Franz ..... B67C 3/04 141/39

(Continued)

FOREIGN PATENT DOCUMENTS

DE 22 51 018 5/1974
DE 22 59 275 6/1974

(Continued)

*Primary Examiner* — Jason K Niesz
*Assistant Examiner* — James Hakomaki
(74) *Attorney, Agent, or Firm* — Occhiuti & Rohlicek LLP

(57) ABSTRACT

A filling element includes a common actuator that controls both a liquid valve and a gas valve. The actuator implements a two-stage control stroke. In a first operating state, both the liquid valve and the gas valve are closed. As a result of a first partial stroke in the second operating state, the gas valve opens but the liquid valve remains closed. Then, in a third operating state, as a result of a second partial stroke, the liquid valve is opens while the gas valve remains open.

9 Claims, 5 Drawing Sheets

(56) References Cited

U.S. PATENT DOCUMENTS 2,676,742 A * 4/1954 Day ..... B67C 3/08 141/141
2,783,785 A * 3/1957 Day ..... B67C 3/06 141/302
3,212,537 A * 10/1965 Hinxlage ..... B67C 3/10 141/39
3,527,267 A * 9/1970 Moore ..... B67C 3/26 141/198
3,834,428 A * 9/1974 Rademacher ..... B67C 3/2628 141/39
3,946,770 A * 3/1976 Trinne ..... B67C 3/08 141/14
4,086,943 A * 5/1978 Fernandez ..... B67C 3/08 141/302
4,089,353 A * 5/1978 Antonelli ..... B67C 3/08 141/302
4,103,721 A * 8/1978 Noguchi ..... B67C 3/10 141/302
4,589,453 A * 5/1986 Weiss ..... B67C 3/08 141/39
5,000,234 A * 3/1991 Weiss ..... B67C 3/10 141/40
5,065,799 A * 11/1991 Weiss ..... B67C 3/10 141/39
5,156,200 A * 10/1992 Mette ..... B67C 3/26 141/287
5,209,274 A * 5/1993 LaWarre, Sr. ..... B67C 3/2628 141/302
5,241,996 A * 9/1993 Werner ..... B67C 3/26 141/302
5,313,990 A * 5/1994 Clusserath ..... B67C 3/10 141/147
5,377,726 A * 1/1995 Clusserath ..... B67C 3/12 141/261
6,155,314 A * 12/2000 Ding ..... B67C 3/2617 141/285
6,189,578 B1 * 2/2001 Clusserath ..... B67C 3/10 141/293
7,287,562 B2 * 10/2007 Tanikawa ..... B67C 3/2614 141/367
8,496,031 B2 * 7/2013 Jenne ..... B67C 3/06 141/285
2005/0198921 A1 * 9/2005 Clusserath ..... B67C 3/002 53/136.1
2005/0262804 A1 * 12/2005 Clusserath ..... B67C 3/20 53/281
2007/0006939 A1 * 1/2007 Clusserath ..... B67C 3/2628 141/40
2011/0197996 A1 * 8/2011 Clusserath ..... B67C 3/001 141/311 R
2011/0272057 A1 * 11/2011 Clusserath ..... B67C 3/06 141/1
2015/0274332 A1 * 10/2015 Gai ..... B67C 3/262 141/311 R

FOREIGN PATENT DOCUMENTS

| | | |
|---|---|---|
| DE | 75 36 390 | 4/1976 |
| DE | 20 2005 004 090 | 6/2005 |
| EP | 0 953 542 | 11/1999 |
| FR | 1 100 155 | 9/1955 |
| GB | 492 367 | 9/1938 |

* cited by examiner

FILLING SYSTEM

RELATED APPLICATIONS

This is the national stage under 35 USC 371 of international application PCT/EP2014/063804, filed on Jun. 30, 2014, which claims the benefit of the Jul. 9, 2013 priority date of German application DE102013107260.7, the contents of which are herein incorporated by reference.

FIELD OF INVENTION

The invention relates to container processing, and in particular, to filling a container.

BACKGROUND

Known single-chamber filling systems are only suitable for pressurized filling of a container that is sealed against a filling element of the filling system. In such systems, pressure within the product vessel holds the filling element's liquid valve closed until a pressure balance occurs between the vessel and the container's interior. This occurs when a gas valve in a gas channel opens to connect the container's interior to the vessel. As a result, a liquid valve opens.

Filling under reduced pressure is difficult with known filling systems mainly because of friction forces associated with moving a valve body and/or its valve tappet during opening and closing.

A further disadvantage of the known filling system is the presence of closing springs, guides, and/or fixing elements of the filling elements in the vessel's interior. These pose a hygiene risk.

SUMMARY

An object of the invention is that of providing a filling system that avoids the above-mentioned disadvantages and is suitable for pressurized and unpressurized container filling.

One feature of the filling system according to the invention is that a common actuator controls both a liquid valve and a gas valve present in the gas channel. Preferably, the actuator is a pneumatic actuator. The actuator implements a two-stage control stroke. In a first operating state, both the liquid valve and the gas valve are closed. As a result of a first partial stroke in the second operating state, the gas valve opens but the liquid valve remains closed. Then, in a third operating state, as a result of a second partial stroke, the liquid valve is opens while the gas valve remains open.

For pressurized filling, the second partial stroke preferably takes place after a long enough delay to enable gas from the vessel to pressurize the container before the liquid valve opens.

In one embodiment, the actuator includes a tappet that parallel or coaxial with a vertical filling-element axis. The tappet moves axially in partial strokes and, via an adapter, acts on a valve body of the gas valve and on a valve tappet of the liquid valve. The adapter forms a first control face that, already at the start of the first partial stroke, comes to rest against a control portion of the valve body of the gas valve and moves this axially to open the gas valve, preferably moving this axially upward. The adapter has a second control face that only comes to rest against a control portion of the valve tappet of the liquid valve at the end of the first partial stroke or during the second partial stroke, and moves the valve tappet, preferably moving it axially upward. In the preferred embodiment, the adapter has a third control face. When the actuator is in the first state, the third control face lies against the control portion of the valve tappet of the liquid valve and holds the liquid valve in the closed position via this tappet.

In one aspect, the invention features an apparatus for filling at least one of bottles and containers with a liquid filling-product. Such an apparatus includes a single-chamber filling system having a filling-product vessel and one or more filling elements arranged below the filling-product vessel. In operation, the partially-filled filling-product vessel defines a liquid space and a gas space above the liquid space. The filling element, which extends along a filling-element axis, includes a housing, a liquid channel, a discharge opening, a liquid valve, a gas valve, a liquid valve-body, a liquid-valve tappet, a gas valve body, and an actuator. The liquid channel extends through the housing between a connection to the liquid space and the discharge opening, which is disposed at an end of the liquid channel at an underside of the housing, the underside facing away from the filling-product vessel such that, during filling, liquid product flows into a container through the discharge opening. The liquid valve is arranged in the liquid channel such that the liquid-valve body is arranged coaxially with the filling-element axis so as to be movable axially along the filling-element axis for opening and closing the liquid valve. The liquid-valve tappet is provided on the liquid-valve body. The liquid valve permits controlled discharge of the filling product into a container arranged in a sealed position against the filling element during a filling operation. The gas channel extends through the liquid-valve tappet between an upper end that opens into the gas space and a lower end that, in operation, extends into a head space of the container. The gas valve is provided in the gas channel such that movement of the gas-valve body opens and closes the gas valve. The actuator includes a pneumatic actuator that cooperates with the liquid-valve tappet and with the gas-valve body to cause a controlled motion that includes at least a first and second partial strokes. The first partial stroke causes the actuator to transition from a first operating state to a second operating state. The second partial stroke causes the actuator to transition from the second operating state to a third operating state. In the first operating state, the liquid valve is closed and the gas valve is closed. In the second operating state, the liquid valve is closed and the gas valve is opened. And, in the third operating state, the liquid valve is opened and the gas valve is opened.

In some embodiments, the gas-valve body is movable along the filling-element axis for opening and closing the gas valve, and wherein the gas-valve body cooperates with a valve face formed in the gas channel. Among these are embodiments in which gas channel includes a partial length that receives the gas-valve body, the gas-valve body includes an upper end that protrudes of the gas channel, and the upper end cooperates with the actuator.

In other embodiments, the actuator includes an adapter, an actuator-tappet, a first lift-element, and a second lift-element. In these embodiments, the first and second lift-elements are coaxial with the filling-element axis, the adapter is coupled to the liquid-valve tappet and the gas-valve body, the second lift-element is disposed to form a stop for stroke movement of the first lift-element, such that when the second lift-element is in a first state, the stroke movement of the first lift-element is limited to the first partial stroke, and when the second lift-element is in a second state, the stroke of the first lift-element is equal to a sum of the extents of the first and second partial strokes.

Among these are embodiments in which the piston-cylinder arrangements are lift elements.

Embodiments that have an adapter include those in which the adapter has first and second control-faces. In these embodiments, the liquid-valve tappet includes a control portion. The gas-valve body lies against the first control-face during the first partial-stroke. The second control-face is axially offset from the control portion when the actuator is in the first operating state. During axial motion of the liquid-valve tappet, the second control-face engages the control portion only during the second partial-stroke. Among these embodiments are those in which a spring urges the adapter upward. In these embodiments, the adapter includes a third control face that, when the actuator is in the first operating state, lies against the control portion of the valve tappet. In some of these embodiments, an axial distance between the second control-face and the third control-face is at least equal to an extent of the first partial stroke plus a thickness of the control portion arranged between the second control-face and the third control-face.

In some embodiments, a spring pre-loads the liquid valve. Among these are embodiments in which it pre-loads the liquid valve to be in a closed state and embodiments in which it pre-loads it to be in the open state.

As used herein, "pressurized filling" refers to a filling process in which a container to be filled is sealed against the filling element and preloaded with pressurized gas before the liquid valve opens to admit filling material. The gas used to pressurize comes from the gas space of the filling-product vessel via a gas channel. During filling, the filling material displaces this gas from the container's interior and causes it to return to the vessel.

As used herein, the term "unpressurized filling" generally refers to a filling process in which the container to be filled can but need not lie with its container mouth in a sealed position on the filling element, and in which, before the actual filling phase, the container interior is connected to the gas space of a filling product vessel maintained at atmospheric pressure via the gas channel through which, during filling, the gas which is increasingly displaced by the filling product flowing into the container is returned to the gas space of the filling product vessel as a return gas.

As used herein, references to a container being "sealed against" a filling element or being "in a sealed position on the filling element" refer to a container having its mouth tightly pressed against the filling element or against a seal situated there.

As used herein, the term "containers" refers to cans and bottles, whether made of metal, glass, and/or plastic.

As used herein, expressions such as "substantially" or "approximately," or "around" refer to deviations from the precise value by ±10%, preferably by ±5%, and/or deviations in the form of changes that are insignificant for function.

Refinements, advantages, and possible applications of the invention arise from the description below of exemplary embodiments and from the figures. All features described and/or shown in the figures, alone or in arbitrary combination, in principle form the subject of the invention irrespective of their summary in the claims or back reference. The content of the claims is also declared a constituent part of the description.

BRIEF DESCRIPTION OF THE DRAWINGS

These and other features and advantages of the invention will be apparent from the following detailed description and the accompanying figures, in which.

DETAILED DESCRIPTION

Figure 1:
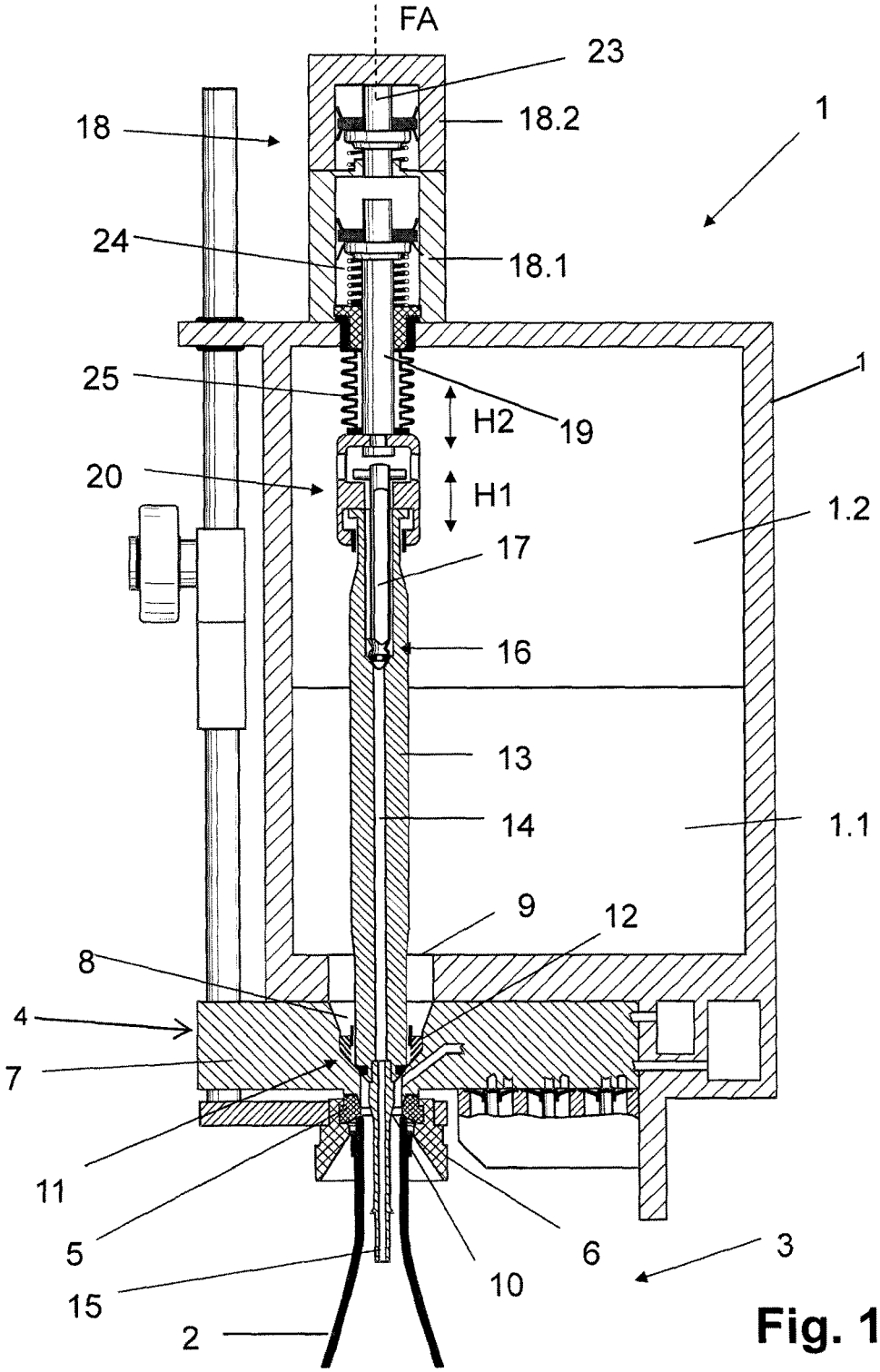
FIGS. 1-3 show a vertical cross section of a filling element.

FIG. 1 shows a ring vessel 1 of a rotary filling machine for filling containers 2 with liquid filling-product. The vessel 1 is part of a rotor that can be driven to rotate about a vertical machine axis MA. The machine axis MA defines a polar coordinate system (r, θ) with the periphery of the rotor being located at r=R.

During the filling operation, filling product partially fills the vessel 1 up to a controlled level. The filling product thus divides the vessel's interior into a liquid space 1.1 filled with filling product and a gas space 1.2 that is filled with an inert gas, such as carbon dioxide, nitrogen, or sterile air.

A plurality of filling positions 3 is formed on the underside of the vessel 1. An $n^{th}$ filling position 3 is located at (R, $n\theta_o$), where n is an integer and $\theta_o$ is a fixed angular spacing between any two filling positions 3.

Each filing position 3 has a filling element 4 and a container carrier, which is not shown and on which a container 2 stands on its bases. The container carrier holds the container 2 so that it can be sealed against the filling element 4 with its opening pressed over a ring seal 5 of a centering sleeve 6 during the filling operation.

Each filling element 4 has a flat, plate-like filling-element housing 7 having a liquid channel 8 formed therein. A first opening 9 on a floor of the vessel 1 connects the liquid channel 8 to the liquid space 1.1. A second opening 10 on an underside of the housing 7 forms a dispensing opening for the liquid channel 8. It is through this second opening 10 that liquid filling-product flows into a container 2. The ring seal 5 surrounds this second opening 10.

A liquid valve 11 inside the liquid channel 8 controls the discharge of liquid filling-product into the container 2. The liquid valve 11 includes a liquid-valve body 12 formed on a tubular valve-tappet 13 that is coaxial with a vertical filling-element axis FA. When the liquid valve 11 closes, the liquid-valve body 12 lies against a liquid-valve seat formed in the liquid channel 8. Moving the liquid-valve body 12 up and down along the filling-element axis FA opens and closes the liquid valve 11.

The valve tappet 13 also defines a gas channel 14 that continues into a gas pipe 15 extending into a headspace of a container 2 sealed against the filling element 4. The lower end of this gas pipe 15 forms the gas channel's lower opening within the container 2. The gas channel's upper opening opens into the gas space 1.2.

A gas valve 16 at an upper portion of the gas channel 14 controls flow of gas through the gas channel 14. The gas valve 16 includes a needle-like gas-valve body 17 that is coaxial with the filling-element axis FA. When the gas-valve 16 closes, a valve face of the gas-valve body 17 lies against a gas-valve seat formed in the gas channel 14 and hence blocks the gas valve 16. The needle-like gas-valve body 17 has a cross-section that is selected such that the gas channel 14 surrounds the gas-valve body 17 up to the upper open end of the valve tappet 13. Raising the gas-valve body 17 relative to the valve tappet 13 opens the gas valve 16. Lowering it relative to the valve tappet 13 closes the gas valve 1.

A pneumatic actuator 18 on top of and outside the vessel 1 controls both the liquid valve 11 and the gas valve 16. The pneumatic actuator 18 acts via an actuator tappet 19 that is coaxial with the filling-element axis FA.

Figure 5:
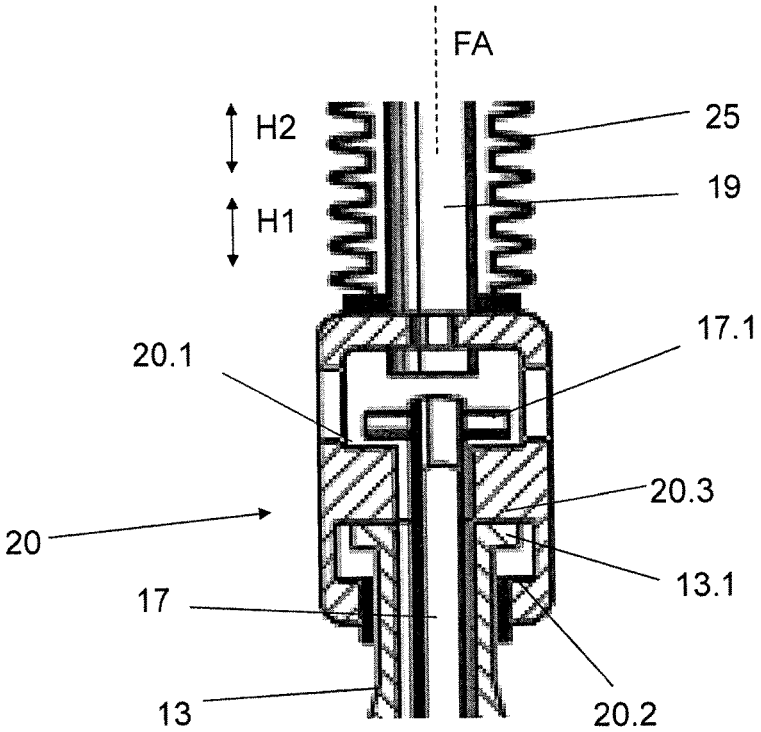
FIG. 5 shows a cross section of an adapter or control adapter from the filling element shown in FIGS. 1-3.
Figure 6:
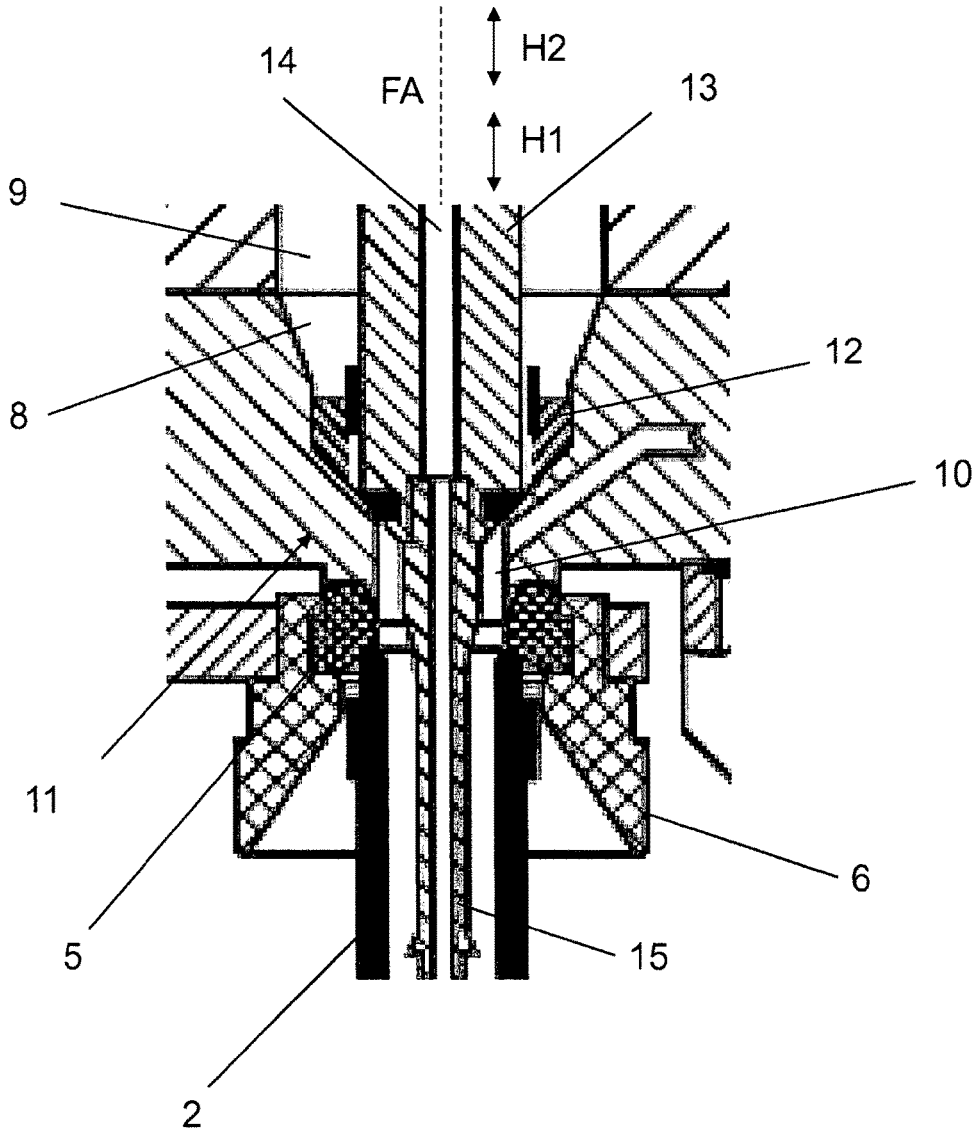
FIG. 6 is a close-up view of a cross-section of the filling element of FIGS. 1-3 in the region of its liquid valve and its discharge opening.

Referring to FIG. 5, an adapter 20 couples the actuator tappet 19 with a first control portion 17.1 at an upper end of the gas-valve body 17 and with a second control portion 13.1 at an upper end of the valve tappet 13. Electro-pneumatic control valves permit the actuator 18 to cause the actuator tappet 19, and hence the adapter 20 along the filling-element axis FA. To enable this, the adapter 20 features a lower piston-cylinder arrangement 18.1 and an upper piston-cylinder arrangement 18.2, each of which forms a pneumatic lift element.

Figure 4:
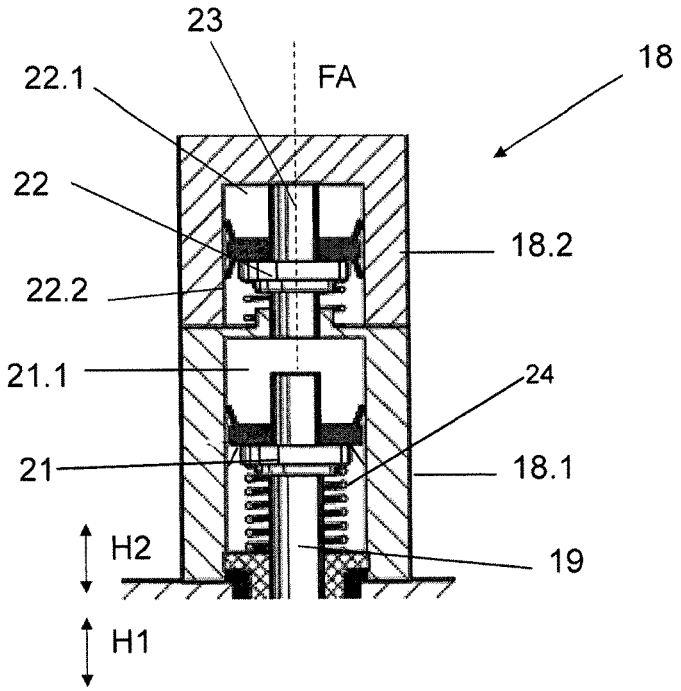
FIG. 4 shows a cross section of an actuator from the filling element shown in FIGS. 1-3.

Referring to FIG. 4, the lower piston-cylinder arrangement 18.1 forms a lower control chamber 21.1 and includes a lower piston 21. The actuator tappet 19 is effectively a lower-piston rod of this lower piston 21. An opening spring 24 surrounds the actuator tappet 19.

Meanwhile, the upper piston cylinder arrangement 18.2 forms a supra-piston control chamber 22.1 above an upper piston 22 and a sub-piston control chamber 22.2 lying below the upper piston 22. The upper piston 22 has an upper-piston rod 23 that is coaxial with the filling-element axis FA.

A chamber of the lower piston-cylinder arrangement 18.1 outside the filling product vessel 1 receives the opening spring 24. The adapter 20 enables the opening spring 24 to open the liquid valve 11 and the gas valve 16. A bellows seal 25 seals the passage region of the actuator tappet 19 through the top of the filling product vessel 1.

In FIG. 1, the actuator 18 has placed the filling element 4 in a first operating state. In this first operating state, both the liquid valve 11 and the gas valve 16 are closed, and a control pressure pressurizes the lower control chamber 21.1. This control pressure generates a closing force that overcomes the spring force of the opening spring 24.

Figure 2:
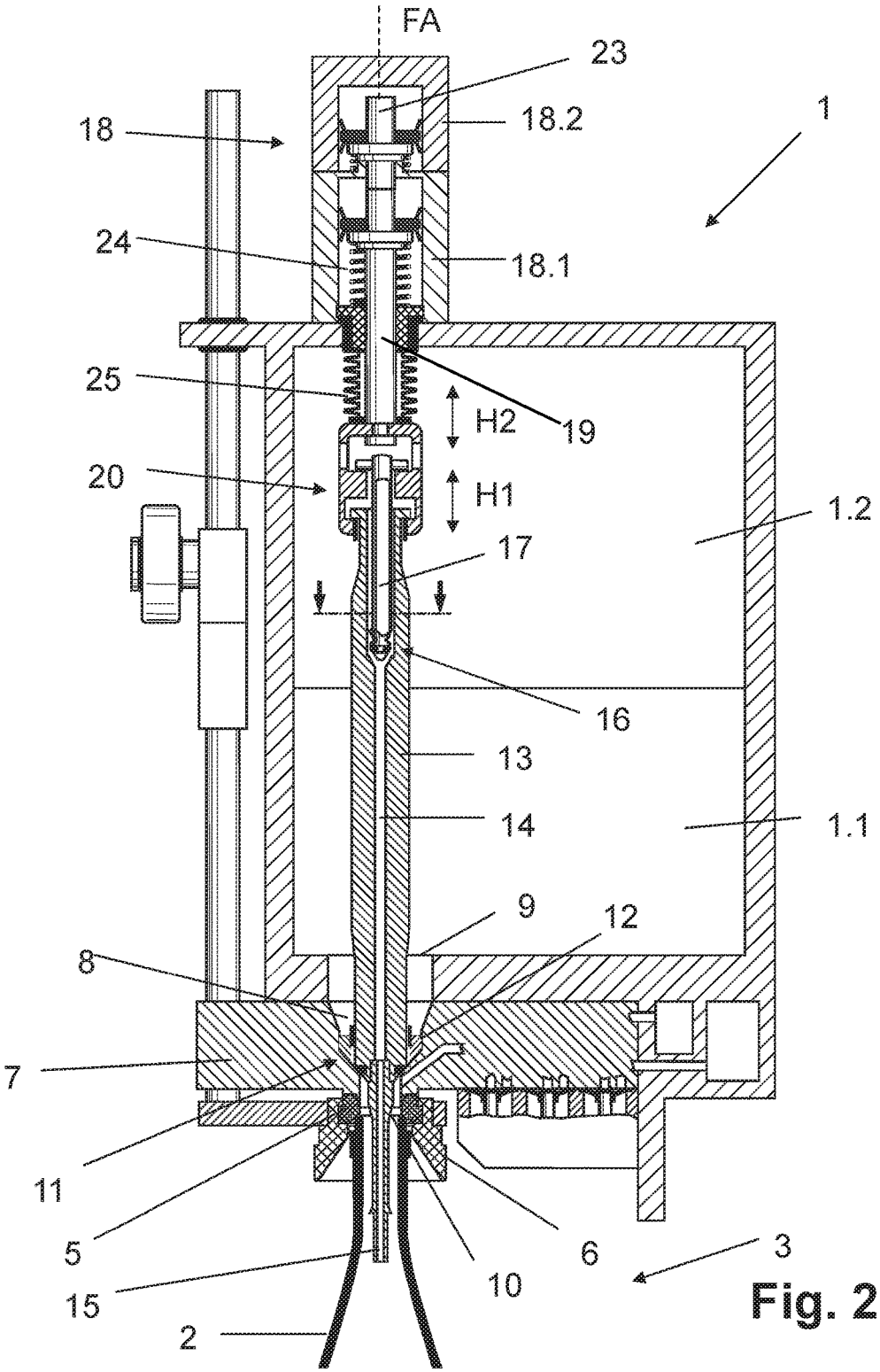

In FIG. 2, the actuator 18 has placed the filling element 4 in a second operating state. In this second operating state, a container 2 is sealed against the filling element 4, the gas valve 16 is open and the liquid valve 11 is closed.

To reach the second operating state shown in FIG. 2, the lower control-chamber 21.1 is depressurized so that the opening spring 24 can lift the adapter 20. A resulting first partial stroke H1 moves the gas-valve body 17 upward, thus opening the gas valve 16. This permits the container interior to be preloaded with pressurized gas through the gas channel 14. With the gas valve 16 open, it is also possible to provide a pressure balance between the container's interior and the gas space 1.1.

Meanwhile, compressed air pressurizes the supra-piston control chamber 22.1 above the upper piston 22. Thus, when the upper end of the actuator tappet 19 comes to rest against the upper-piston rod 23 of the upper piston-cylinder arrangement 18.2, the pressurized supra-piston control chamber 22.1 limits the first partial stroke H1.

Figure 3:
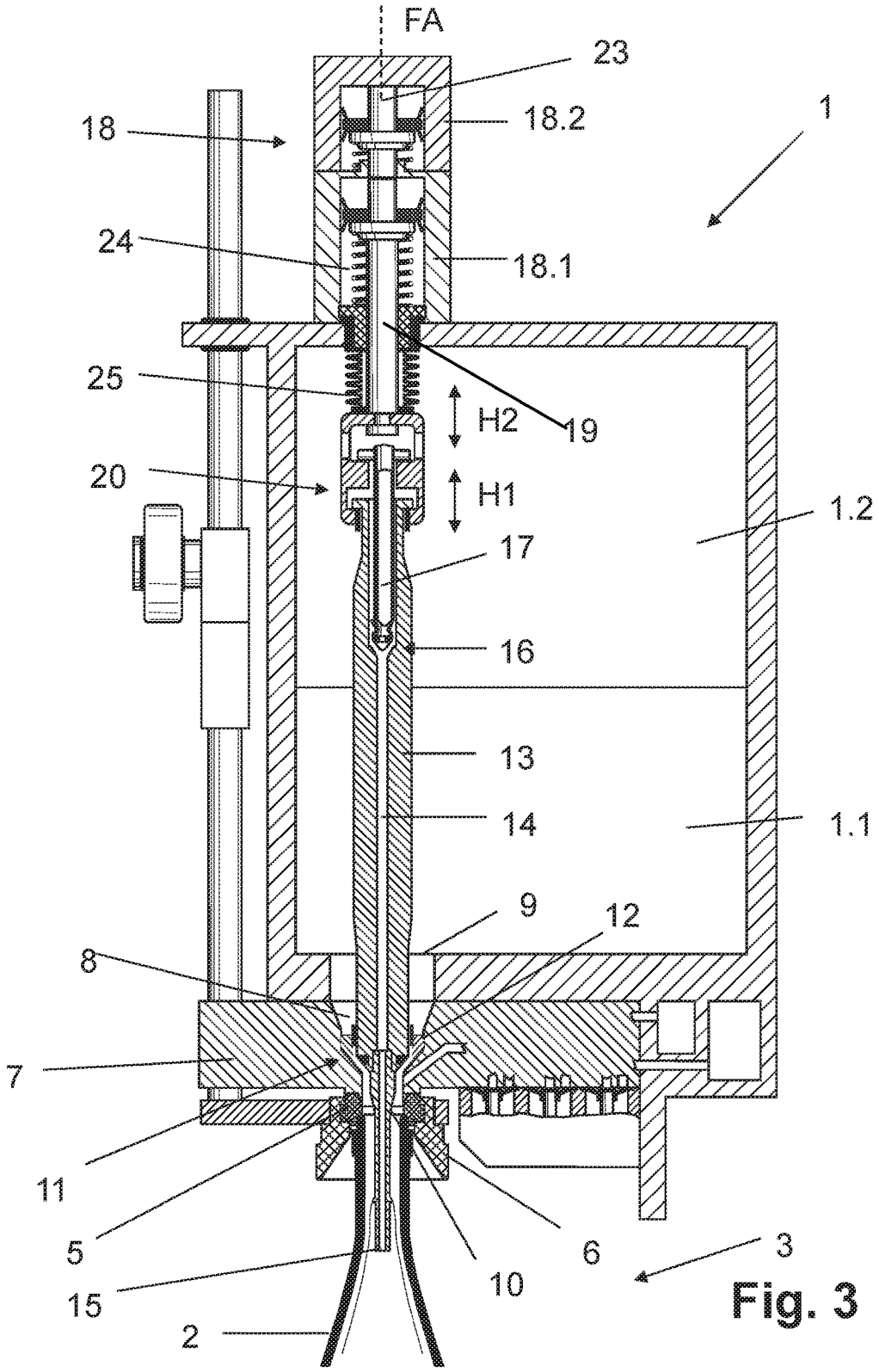

In FIG. 3, the actuator 18 has placed the filling element 4 in a third operating state in which the liquid valve 11 is now open. In this third operating state, the supra-piston control chamber 22.1 and the lower control chamber 21.1 have been depressurized. This permits the opening spring 24 to further lift the liquid-valve tappet 13 in a second partial stroke H2 of the actuator 18. This, in turn, opens the liquid valve 11.

Referring to FIG. 5, the adapter 20 is configured such that, by the completion of the first partial stroke H1, a first control face 20.1 thereof has engaged the first control portion 17.1 of the gas-valve body 17, but a second control face 20.2 of the adapter 20 does not engaged the second control portion 13.1 of the liquid-valve tappet 13 until after the second partial stroke H2 has begun. As a result, the liquid-valve tappet 13 cannot begin to move until after the second partial stroke H2 has begun.

In the embodiment shown, this delayed opening of the liquid valve 11 is achieved by having the second control portion 13.1 be a plate or flange and having the adapter 20 undercut the liquid-valve tappet 13 at its upper end below the second control portion 13.1. Furthermore the arrangement is such that, during the first partial stroke H1, the adapter 20 moves up along the liquid-valve tappet 13 without coming to rest against the second control portion 13.1 and thus lifting the liquid-valve tappet 13.

During the filling procedure, liquid filling-product flowing into the container displaces gas already present therein. The now open gas channel 14 conducts this displaced gas into the gas space 1.2.

As the level of filling product rises, eventually it submerges the gas pipe 15 that extends into the headspace of the container 2. When this happens, the gas in the container can no longer be enter the gas pipe 15. As a result, filling stops. In this way, the lower open end of the gas channel 14 determines the fill level.

Once filling is complete, the actuator 18 closes both the liquid valve 11 and the gas valve 13 by the lowering the adapter 20 and pressurizing the lower control chamber 21.1 with the control pressure. Meanwhile, gravity moves the gas-valve body 17 downward along the filling-element axis FA, thus closing the gas valve 16. The liquid valve 11 closes when the adapter 20 comes to rest with a third control face 20.3 against the top of the second control portion 13.1 and the control pressure in the lower control chamber 21.1 presses the liquid-valve body 12 against its liquid-valve seat.

The invention has been described above with reference to an exemplary embodiment. Numerous changes and derivations are possible without leaving the inventive concept on which the invention is based. Thus instead of the first and second piston-cylinder arrangements 18.1, 18.2, other pneumatic lifting elements may be used.

Having described the invention, and a preferred embodiment thereof, what is claimed as new, and secured by Letters Patent is:

1. An apparatus for filling at least one of bottles and containers with a liquid filling-product, said apparatus comprising a single-chamber filling system comprising a filling-product vessel and a filling element arranged below said filling-product vessel, wherein, in operation, said filling-product vessel is partially filled with liquid product that defines a liquid space and a gas space above said liquid space, wherein said filling element extends along a filling-element axis, wherein said filling element comprises a housing, a liquid channel, a discharge opening, a liquid valve, a gas valve, a liquid valve-body, a liquid-valve tappet, a gas-valve body, a gas channel, and an actuator, wherein said liquid channel extends through said housing between a connection to said liquid space and said discharge opening, which is disposed at an end of said liquid channel at an underside of said housing, said underside facing away from said filling-product vessel such that, during filling, liquid product flows into a container through said discharge opening, wherein said liquid valve is arranged in said liquid channel such that said liquid-valve body is arranged coaxially with said filling-element axis so as to be movable axially along said filling-element axis for opening and closing said liquid valve, wherein said liquid-valve tappet is provided on said liquid-valve body, wherein said liquid valve is configured to permit controlled discharge of said filling product into a container arranged in a sealed position against said filling element during a filling operation, wherein said gas channel extends through said liquid-valve tappet between an upper end that opens into said gas space and a lower end that, in operation, extends into a head space of said container, wherein said gas valve is provided in said gas channel such that movement of said gas-valve body opens and closes said gas valve, wherein said actuator comprises a pneumatic actuator that is configured to cooperate with said liquid-valve tappet and with said gas-valve body to cause a controlled motion that comprises at least a first partial stroke and a second partial stroke, wherein said actuator is configured such that said first partial stroke causes said actuator to transition from a first operating state to a second operating state, and said second partial stroke causes said actuator to transition from said second operating state to a third operating state, wherein, when said actuator is in said first operating state, said liquid valve is closed and said gas valve is closed, wherein, when said actuator is in said second operating state, said liquid valve is closed and said gas valve is opened, and wherein, when said actuator is in said third operating state, said liquid valve is opened and said gas valve is opened, wherein said actuator comprises an adapter, an actuator-tappet, a first lift-element, and a second lift-element, wherein said first and second lift-elements are coaxial with said filling-element axis, wherein said adapter is coupled to said liquid-valve tappet, said actuator tappet, and said gas-valve body, wherein said actuator-tappet moves said first lift-element, wherein said second lift-element is disposed to form a stop for stroke movement of said first lift-element such that when said second lift-element is in a first state, said stroke movement of said first lift-element is limited to said first partial stroke, and when said second lift-element is in a second state, said stroke of said first lift-element is equal to a sum of extents of said first and second partial strokes.

2. The apparatus of claim 1, wherein said gas-valve body is movable through said a gas channel that is formed through a liquid-valve tappet that extends along said filling-element axis for opening and closing said gas valve, wherein said gas-valve body cooperates with a valve face formed in said gas channel, wherein said gas-valve body extends through an aperture in said valve face when said gas valve is open, and wherein said gas-valve body extends through said aperture when said gas valve is closed.

3. The apparatus of claim 2, further wherein said gas channel comprises a partial length that passes through said liquid-valve tappet and that receives said gas-valve body, wherein said gas-valve body comprises an upper end that protrudes from out of said liquid-valve tappet, and wherein said upper end of said gas-valve body selectively contacts said actuator.

4. The apparatus of claim 1, wherein said first lift-element comprises a first piston-cylinder arrangement, and wherein said second lift-element comprises a second piston-cylinder arrangement.

5. The apparatus of claim 1, wherein said adapter comprises a first control-face and a second control-face, wherein said liquid-valve tappet comprises a control portion, wherein said gas-valve body lies against said first control-face during said first partial-stroke, wherein said second control-face is axially offset from said control portion when said actuator is in said first operating state, wherein, during axial motion of said liquid-valve tappet, said second control-face engages said control portion only during said second partial-stroke.

6. The apparatus of claim 5, further comprising a spring that is configured to act on said adapter to urge said adapter upward, wherein said adaptor comprises a third control face that, when said actuator is in said first operating state, lies against said control portion of said liquid-valve tappet.

7. The apparatus of claim 6, wherein an axial distance between said second control-face and said third control-face is at least equal to an extent of said first partial stroke plus a thickness of said control portion arranged between said second control-face and said third control-face.

8. The apparatus of claim 1, further comprising a spring configured to pre-load said liquid valve.

9. The apparatus of claim 8, wherein said spring is configured to pre-load said liquid valve towards a closed state, wherein said spring is disposed above said gas-valve body.

* * * * *